US005710965A

United States Patent [19]

Nozawa et al.

[11] Patent Number: 5,710,965

[45] Date of Patent: Jan. 20, 1998

[54] DEVELOPER FOR DEVELOPING ELECTROSTATIC IMAGES AND IMAGE FORMING METHOD

[75] Inventors: Keita Nozawa; Tsutomu Kukimoto, both of Yokohama; Satoshi Matsunaga; Kazuyoshi Hagiwara, both of Tokyo, all of Japan

[73] Assignee: Canon Kabushiki Kaisha, Tokyo, Japan

[21] Appl. No.: 515,327

[22] Filed: Aug. 15, 1995

[51] Int. Cl.[6] ..... G03G 15/16

[52] U.S. Cl. ..... 399/313; 430/110; 430/111; 430/126

[58] Field of Search ..... 355/245–6, 219, 355/277, 271; 430/109, 110, 111, 125, 126; 118/656–657; 399/222, 252, 310, 313, 314

[56] References Cited

U.S. PATENT DOCUMENTS

| | | | |
|---|---|---|---|
| 5,270,770 | 12/1993 | Kukimoto et al. | 355/274 |
| 5,392,103 | 2/1995 | Kukimoto et al. | 355/274 |
| 5,447,815 | 9/1995 | Kato et al. | 430/110 |
| 5,532,101 | 7/1996 | Nozawa et al. | 430/125 |
| 5,534,981 | 7/1996 | Ohno et al. | 355/245 |

FOREIGN PATENT DOCUMENTS

| | | |
|---|---|---|
| 59-46664 | 3/1984 | Japan . |
| 3121462 | 5/1991 | Japan . |

*Primary Examiner*—William J. Royer

*Attorney, Agent, or Firm*—Fitzpatrick, Cella, Harper & Scinto

[57] ABSTRACT

A developer for developing electrostatic images has a toner and an aggregate of fine particles. The aggregate holds a silicone compound selected from the group consisting of a silicone oil and a silicone varnish, in an amount of from 20% by weight to 90% by weight.

64 Claims, 4 Drawing Sheets

DEVELOPER FOR DEVELOPING ELECTROSTATIC IMAGES AND IMAGE FORMING METHOD

BACKGROUND OF THE INVENTION

1. Field of the Invention

This invention relates to a developer for developing electrostatic images, and an image forming method, used in electrophotography, electrostatic recording or the like.

2. Related Background Art

In image forming systems comprising the step of electrostatically transferring a toner image formed on the surface of a latent image bearing member having an electrostatic image, to a transfer medium having sheet form such as paper, a system is proposed which makes use of a latent image bearing member driven in the form of a rotary cylinder or an endless belt and is so constructed that a transfer assembly to which a bias voltage is applied is brought into pressure contact with the latent image bearing member and the transfer medium is passed between the both so that the toner image on the side of the latent image bearing member is transferred to the transfer medium (e.g., Japanese Patent Application Laid-open No. 59-46664).

In such a system, the pressing force of a transfer roller against the latent image bearing member can be adjusted to thereby expand the region of attraction of the transfer medium to the latent image bearing member, compared with transfer means utilizing corona discharge which are hitherto widely put into practical use. Since also the transfer medium is actively pressed against and supported at the transfer portion, there is no possibility of causing faulty synchronization ascribable to transfer medium transport means or causing transfer aberration due to loops and curl present in transfer mediums, and hence such a system can easily meet the demand for making the transfer medium transport path shorter and making the latent image bearing member smaller in diameter as the size of image forming devices is made smaller.

On the other hand, in the system where the transfer is performed by contact pressure, it is necessary to apply a certain degree of pressure to the transfer assembly since transfer currents are supplied from the contact portion. When a contact pressure is applied, a pressure is also applied to the toner image on the latent image bearing member to tend to cause agglomeration of toner.

When the surface of the latent image bearing member is formed of a resin, adhesion may also occur between toner agglomerates and the latent image bearing member to obstruct the transfer to the transfer medium, so that in an extreme instance a phenomenon tends to occur such that the part firmly adhering is not transferred to cause defective toner images.

This phenomenon remarkably occurs especially at line areas of 0.1 to 2 mm thick. This is because the toner is laid on the line areas in a large quantity because of the edge effect to tend to cause the agglomeration due to the application of pressure and tend to cause defects at the time of transfer. When this occurs, the toner image formed appears as a reproduction in which only the outline of an image is formed, which is called "blank areas caused by poor transfer". Examples of the blank areas caused by poor transfer are illustrated in FIGS. 1B and 2B.

The "blank areas caused by poor transfer" tend to occur especially when copies are taken on, e.g., cardboad of 100 g/cm$^2$ or more, OHP films having a high smoothness, and the second side in double-side copying. In the cases of the cardboad and the OHP films, it is considered that the thickness of the transfer medium is so large that the transfer electric field is less effective and the pressure becomes greater, tending to cause blank areas.

In the case of the copying on the second side in double-side copying, it is considered that the release agent incorporated to prevent offset adheres to the transfer medium from a fixing assembly and obstructs close adhesion between the toner and the transfer medium when the toner image is transferred on the second side, tending to cause blank areas.

When the transfer assembly employing a contact member is used, there are many advantages such that it can be small-sized and driven at a low power, but on the other hand the conditions required on transfer mediums become severe.

To overcome this problem, a method is proposed in Japanese Patent Application Laid-open No. 3-121462 which employs a developer containing a fine powder in an amount of from 0.05 part to 3 parts by weight based on 100 parts by weight of a toner, the fine powder having been treated with silicone oil or silicone varnish. When this method is used, the blank areas caused by poor transfer no longer occur on a transfer medium such as cardboad. However, in order to maintain the fluidity of the developer, this fine powder contains the silicone oil or silicone varnish in an amount kept small and has a BET specific surface area kept high, and hence, in the case of OHP films, having a higher smoothness and a lower adhesion to toner than the cardboad, the fine powder having been treated with such silicone oil or silicone varnish can not be very effective unless added in a large quantity. Thus, it is sought to solve this problem.

SUMMARY OF THE INVENTION

An object of the present invention is to provide a developer for developing electrostatic images that has solved the above problem.

Another object of the present invention is to provide a developer for developing electrostatic images that causes no blank areas caused by poor transfer, even in the case of transfer mediums having a smooth surface and tending to cause blank areas caused by poor transfer, as exemplified by OHP films.

A still another object of the present invention is to provide an image forming method carried out using such a developer.

To achieve the above objects, the present invention provides a developer for developing electrostatic images, comprising a toner and an aggregate of fine particles;

the aggregate holding from 20 to 90% by weight of a silicone compound selected from the group consisting of a silicone oil and a silicone varnish.

The present invention also provides an image forming method comprising;

electrostatically charging a latent image bearing member;

forming an electrostatic image on the latent image bearing member thus charged;

developing the electrostatic image by the use of a developer to form a toner image on the latent image bearing member; and transferring the toner image formed on the latent image bearing member, to a transfer medium through a contact transfer means to which a bias voltage is applied;

wherein the developer comprises a toner and an aggregate of fine particles;

the aggregate holding from 20 to 90% by weight of a silicone compound selected from the group consisting of a silicone oil and a silicone varnish.

DESCRIPTION OF THE PREFERRED EMBODIMENTS

Figure 1A:
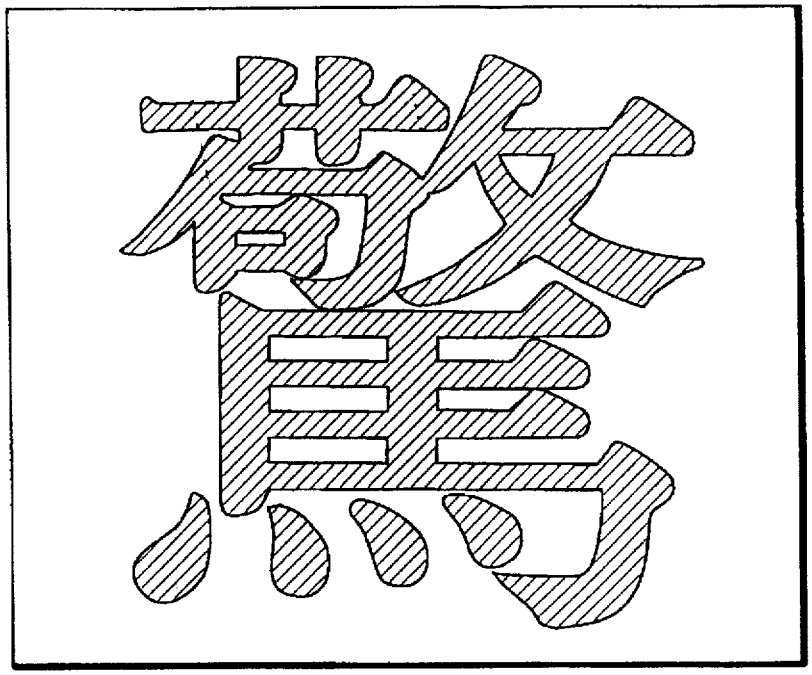
FIG. 1A illustrates a normal image.
Figure 1B:
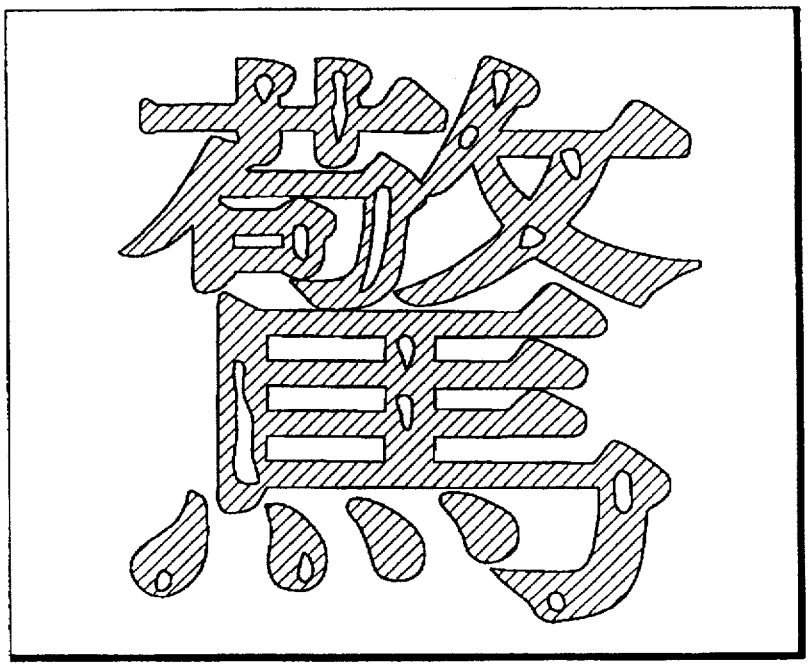
FIG. 1B illustrates an image where the phenomenon of blank areas caused by poor transfer has occurred.
Figure 2A:
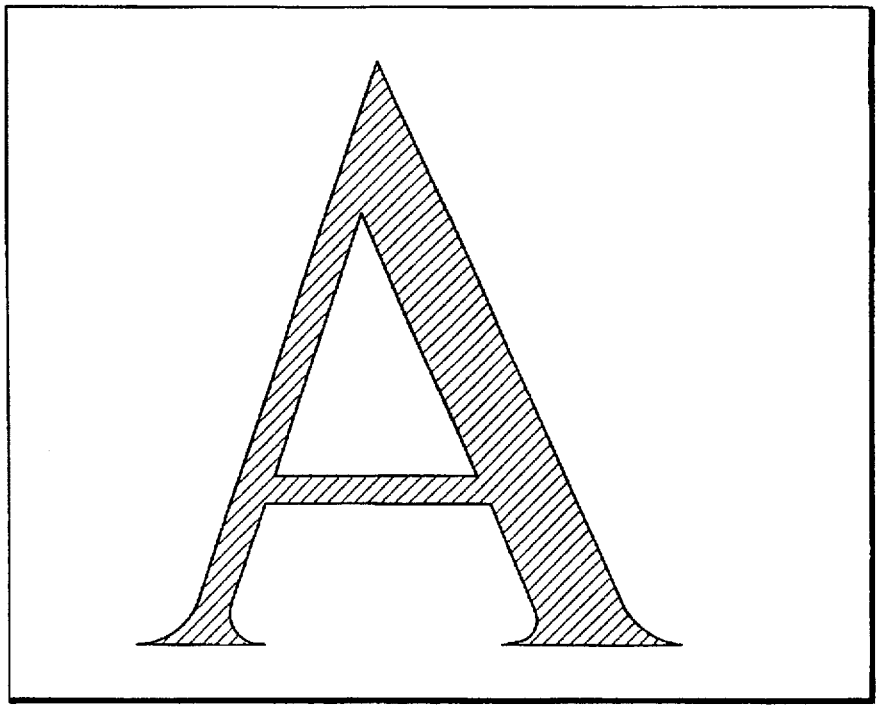
FIG. 2A illustrates a normal image.
Figure 2B:
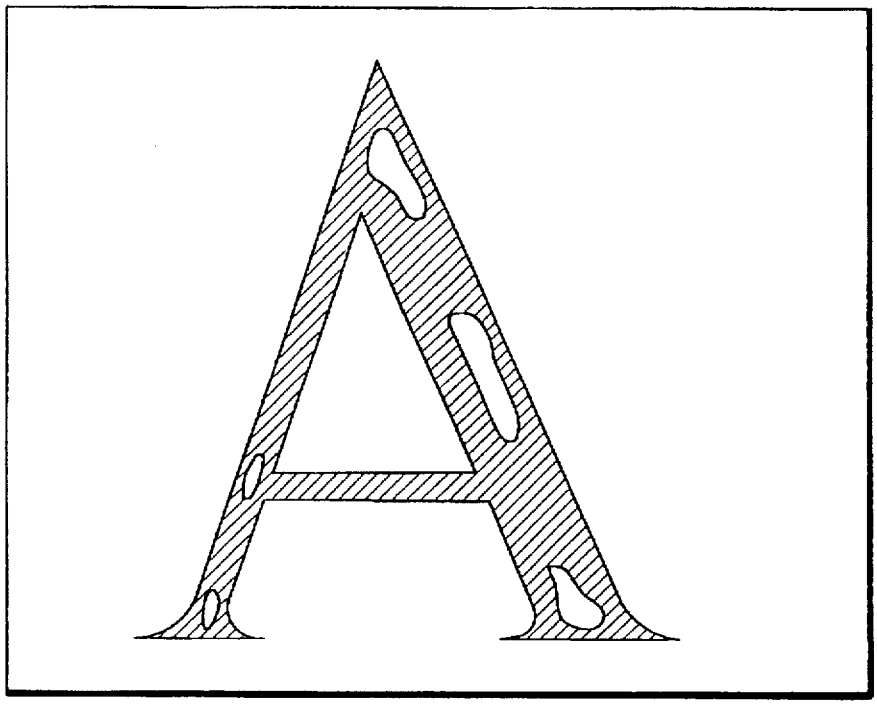
FIG. 2B illustrates an image where the phenomenon of blank areas caused by poor transfer has occurred.

The developer of the present invention is characterized by comprising an aggregate of fine particles which is formed of fine particles and a silicone oil or a silicone varnish. As the fine particles used therein, fine particles of an inorganic compound or fine particles of an organic compound are used. The fine particles of organic compound may include fine particles of a resin such as styrene resin, acrylic resin, silicone resin, silicone rubber, polyester resin, urethane resin, polyamide resin, polyethylene resin or fluorine resin, and fine particles of an aliphatic compound.

The inorganic compound may include oxides such as $SiO_2$, $GeO_2$, $TiO_2$, $SnO_2$, $Al_2O_3$, $B_2O_3$, $P_2O_5$ and $AS_2O_3$; metal oxide salts such as silicate, borate, phosphate, germanate, borosilicate, aluminosilicate, aluminoborate, aluminoborosilicate, tungstate, molybdate and tellurate; composite compounds of any of these; silicon carbide, silicon nitride, and amorphous carbon. These may be used alone or in the form of a mixture.

As the inorganic compound fine particles, inorganic compound fine particles produced by the dry process and those produced by the wet process may be used.

The dry process herein referred to is a process for producing inorganic compound fine particles formed by vapor phase oxidation of a halogen compound. For example, it is a process that utilizes heat decomposition oxidation reaction in the oxyhydrogen of halide gas. The reaction basically proceeds as shown by the following scheme $$MX_n+\tfrac{1}{2}nH_2+\tfrac{1}{4}O_2\rightarrow MO_2+nHCl$$

In this reaction scheme, for example, M represents a metal or semimetal element, X represents a halogen element, and n represents an integer. Stated specifically, when $AlCl_3$, $TiCl_4$, $GeCl_4$, $SiCl_4$, $POCl_3$ or $BBr_3$ is used, $Al_2O_3$, $TiO_2$, $GeO_2$, $SiO_2$, $P_2O_5$ or $B_2O_3$, respectively, are obtained.

Here, composite compounds are obtained when halides are used by mixture.

Besides, dry-process fine particles can be obtained by applying a production process such as thermal CVD or plasma-assisted CVD. In particular, $SiO_2$, $Al_2O_3$, $TiO_2$ and so forth may preferably be used.

Meanwhile, as methods by which the inorganic compound fine particles used in the present invention is produced by the wet process, various conventionally known methods can be used. For example, there is a method in which sodium silicate is decomposed using an acid. The general reaction scheme is shown below.

$$Na_2O\cdot XSiO_2+HCl+H_2O\rightarrow SiO_2\cdot nH_2O+NaCl$$

There are also a method in which sodium silicate is decomposed using an ammonium salt or alkali salt, a method in which an alkaline earth metal silicate is produced from sodium silicate followed by decomposition using an acid to give silicic acid, a method in which an aqueous sodium silicate solution is passed through an ion-exchange resin to give silicic acid, and a method making use of naturally occurring silicic acid or silicate.

Besides, there is a method in which a metal alkoxide is hydrolyzed. The general reaction scheme is shown below.

$$M(OR)_n+\tfrac{1}{2}nH_2O\rightarrow MO_2+nROH$$

In this reaction scheme, for example, M represents a metal or semimetal element, R represents an alkyl group, and n represents an integer. Here, composite compounds are obtained when two or more metal alkoxides are used.

As the fine particles, fine particles of the inorganic compound are preferable in view of their appropriate electrical resistance. Of these, fine particles of the metal oxide are preferred.

In particular, fine particles of an oxide of Si, Al or Ti or a composite oxide of any of these are preferred.

Fine particles whose surfaces have been made hydrophobic by a coupling agent or the like may also be used.

The fine particles may preferably have a particle diameter of from 0.001 to 20 μm, and more preferably from 0.005 to 10 μm.

The fine particles may preferably have a BET specific surface area of from 10 to 400 $m^2/g$, more preferably from 50 to 400 $m^2/g$, and still more preferably from 100 to 350 $m^2/g$. If they have a BET specific surface area smaller than 10 $m^2/g$, it tends to become difficult for the silicone oil or silicone varnish to be held in a large quantity within the range of the present invention and in the integral form of particles having preferable particle diameters.

The silicone oil used in the present invention may preferably be a compound represented by Formula (I):

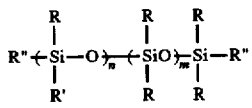

(I)

wherein R represents an alkyl group having 1 to 3 carbon atoms; R' represents a silicone oil modifying group such as alkyl, halogen-modified alkyl, phenyl or modified phenyl; R" represents an alkyl group or alkoxyl group having 1 to 3 carbon atoms; and m and n each represent an integer. It may include, for example, dimethylsilicone oil, alkyl-modified silicone oil, α-methylstyrene-modified silicone oil, chlorophenylsilicone oil and fluorine-modified silicone oil. However, examples are by no means limited to these silicone oils only.

As the silicone varnish used in the present invention, known substances may be used.

For example, it may include KR-251, KP-112 and so forth, available from Shin-Etsu Silicone Co., Ltd. Examples are by no means limited to these.

In the present invention, an amino-modified silicone oil having the structure represented by Formula (II) may also be used as the silicone oil.

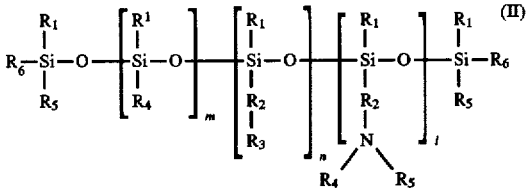

(II)

wherein $R_1$ and $R_6$ each represent a hydrogen atom, an alkyl group, an aryl group or an alkoxyl group; $R_2$ represents an alkylene group or a phenylene group; $R_3$ represents a group having a nitrogen-containing heterocyclic ring in its structure; and $R_4$ and $R_5$ each represent a hydrogen atom, an alkyl group or an aryl group. $R_2$ may be absent. In the foregoing, the alkyl group, the aryl group, the alkylene group and the phenylene group may each contain an amine, or may have a substituent such as a halogen so long as charging performance is not damaged. Letter symbol m is an integer of 1 or more; and n and 1 are each a positive number including 0; provided that n+1 is a positive number of 1 or more.

The amino-modified silicone oil may most preferably have a structure wherein the number of the nitrogen atom in the side chain containing a nitrogen atom is 1 or 2.

Unsaturated heterocyclic rings containing nitrogen can be exemplified by the following:

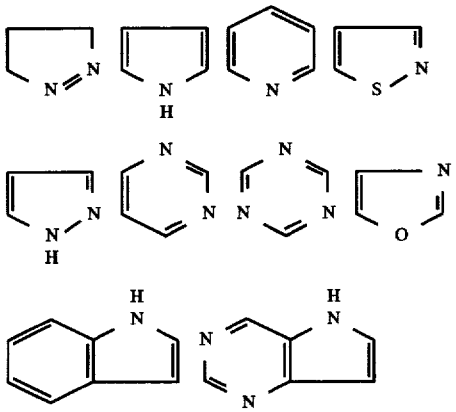

Saturated heterocyclic rings containing nitrogen can be exemplified by the following:

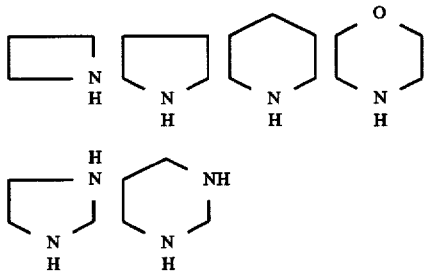

The present invention is by no means restricted by the above examples of compounds. The compunds having a heterocyclic ring structure of 5 members or 6 members are preferred.

Derivatives thereof can be exemplified by derivatives formed by introducing into the foregoing compounds a hydrocarbon group, a halogen atom, an amino group, a vinyl group, a mercapto group, a methacrylic group, a glycidoxy group, a ureido group or the like.

Any of these may be used alone or in the form of a mixture of two or more.

The silicone varnish used in the present invention may include, for example, methylsilicone varnish and phenylmethylsilicone varnish. In particular, the methylsilicone varnish is preferred.

The methylsilicone varnish is a polymer comprised of a $T^{31}$ unit, a $D^{31}$ unit and a $M^{31}$ unit which are represented by the following structural formulas.

$T^{31}$ unit:

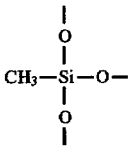

$D^{31}$ unit:

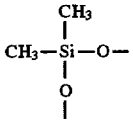

$M^{31}$ unit:

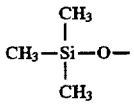

Stated specifically, the methylsilicone varnish or the phenylmethylsilicone varnish are substances having a chemical structure as represented by the following Formula (III).

Formula (III):

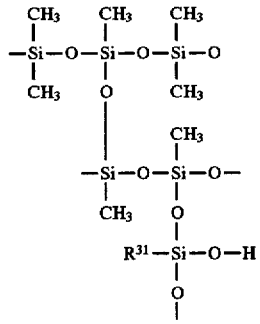

wherein $R^{31}$ represents a methyl group or a phenyl group.

In particular, in the above silicone varnish, the $T^{31}$ unit is a unit effective for imparting a good heat-curability and providing a three-dimensional network structure. The $T^{31}$ unit may preferably be contained in the silicone varnish in an amount of from 10 to 90 mol %, and particularly from 30 to 80 mol %.

Such a silicone varnish has a hydroxyl group at a terminal of its molecular chain or in the side chain thereof, and dehydration condensation of the hydroxyl group cause the compound to cure. A curing accelerator that can be used to accelerate this curing reaction may include, for example, fatty acid salts of zinc, lead, cobalt or tin, and amines such as triethanolamine and butylamine. Of these, amines may particularly preferably be used.

To convert the above-described silicone varnish into an amine-modified silicone varnish, some methyl groups or phenyl groups present in the above $T^{31}$ unit, $D^{31}$ unit and $M^3$ unit may be substituted so as to form groups having an amino group. The groups having an amino group may include, for example, those represented by the following structural formulas.

$-CH_2CH_2-NH_2$ $-CH_2(CH_2)_2-NH_2$ $-CH_2(CH_2)_2-NH-(CH_2)_3-NH_2$

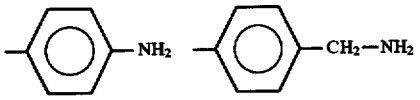

The above silicone oil or silicone varnish may preferably have a viscosity at 25° C. of from 50 to 200,000 centistokes, more preferably from 500 to 150,000 centistokes, and still more preferably from 1,500 to 100,000 centistokes, and still more preferably from 3,000 to 80,000 centistokes.

If it has a viscosity lower than 50 centistokes, it tends to become difficult to well make a large quantity of silicone oil or silicone varnish held in the aggregate of fine particles, and also the aggregate of fine particles tends to have so low a stability that the image quality may deteriorate because of heat and mechanical stress.

If it has a viscosity higher than 200,000 centistokes, it tends to become difficult to form the aggregate comprised of the silicone oil or silicone varnish and the fine particles.

The viscosity of the silicone oil or silicone varnish can be measured using VISCOTESTER VT500 (manufactured by Haake Co.) in the following way.

One of several viscosity sensors for VT500 is selected (arbitrarily), and a sample to be measured is put in a measuring cell for that sensor to make measurement. The viscosity (pas) indicated on the device is calculated into cs (centistokes).

In the aggregate of fine particles, the silicone oil or silicone varnish can be well effective when it is in an amount of from 20 to 90% by weight, preferably from 27 to 85% by weight, and more preferably from 40 to 80% by weight.

If the silicone oil or silicone varnish is in an amount less than 20% by weight, its addition is less effective for the prevention of blank areas caused by poor transfer. On the other hand, if it is in an amount more than 90% by weight, it becomes difficult for the silicone oil or silicone varnish to be held in the aggregate, where the excess silicone oil or silicone varnish cause agglomeration of toner particles to tend to cause deterioration of image quality.

The aggregate comprised of the silicone oil or silicone varnish and the fine particles can provide good results when it has a BET specific surface area of from 0.01 to 50 $m^2/g$, preferably from 0.05 to 30 $m^2/g$, and more preferably from 0.1 to 10 $m^2/g$.

If the aggregate has a BET specific surface area greater than 50 $m^2/g$, the silicone oil or silicone varnish can be held in the aggregate with difficulty, causing agglomeration of toner to tend to cause deterioration of image quality.

If the aggregate has a BET specific surface area greater than 50 $m^2/g$, the blank areas caused by poor transfer tend to be less effectively prevented. If the aggregate has a BET specific surface area smaller than 0.01 $m^2/g$, the image quality tends to deteriorate.

The BET specific surface area is a value calculated in the following way.

According to the BET method, nitrogen gas is adsorbed on sample surfaces using a specific surface area measuring device AUTOSOBE 1 (manufactured by Yuasa Ionics Co.), and the specific surface area is calculated by the BET multiple point method.

The silicone oil or silicone varnish to be dissolved (i.e., a dissolving matter) out of the aggregate comprised of the silicone oil or silicone varnish and the fine particles may preferably be in a quantity of 10% by weight or more of the whole aggregate. If such a dissolving matter is in a quantity less than 10% by weight, the blank areas caused by poor transfer can be less effectively prevented. To measure the dissolving matter, the aggregate comprised of the silicone oil or silicone varnish and the fine particles is subjected to Soxhlet extraction with chloroform by the use of a cylindrical filter paper in an oil bath heated to a temperature of 70° C. or above, followed by evaporation of the extract by means of an evaporator to remove chloroform, and thereafter the weight of the residue is measured to determine the quantity.

The aggregate comprised of the silicone oil or silicone varnish and the fine particles may be used preferably in an amount of from 0.01 to 10 parts by weight, more preferably from 0.03 to 5 parts by weight, and still more preferably from 0.05 to 2 parts by weight, based on 100 parts by weight of the toner. If it is in an amount less than 0.01 part by weight, the blank areas caused by poor transfer can be less effectively prevented. If it is in an amount more than 10 parts by weight, the fixing performance of the toner tends to be damaged.

The aggregate comprised of the silicone oil or silicone varnish and the fine particles according to the present invention contains the silicone oil or silicone varnish, which is a substance with good release properties, in an amount relatively as large as 20% by weight to 90% by weight. This contributes an improvement in the releasability between the toner and the photosensitive member surface.

The silicone oil can be more readily coated on the photosensitive member surface than the silicone varnish, and hence the silicone oil is preferred. No alkoxyl group is contained in the silicone oil, and this is preferable in view of the effect against the blank areas caused by poor transfer.

The silicone oil or silicone varnish is formed into particles integrally with the fine particles and is stably held as integral form of particles. Thus, the toner does not cause agglomeration due to the silicone oil or silicone varnish during its storage, and good-quality images can be obtained which are free of coarse images and black spots around line images.

As a transfer means of the electrophotographic apparatus employing the developer of the present invention, there is a contact type in which a roller or a belt is brought into pressure contact with the latent image bearing member and a non-contact type making use of a corona charging assembly. Of these, the developer of the present invention is especially remarkably effective when the contact type is used.

Figure 3:
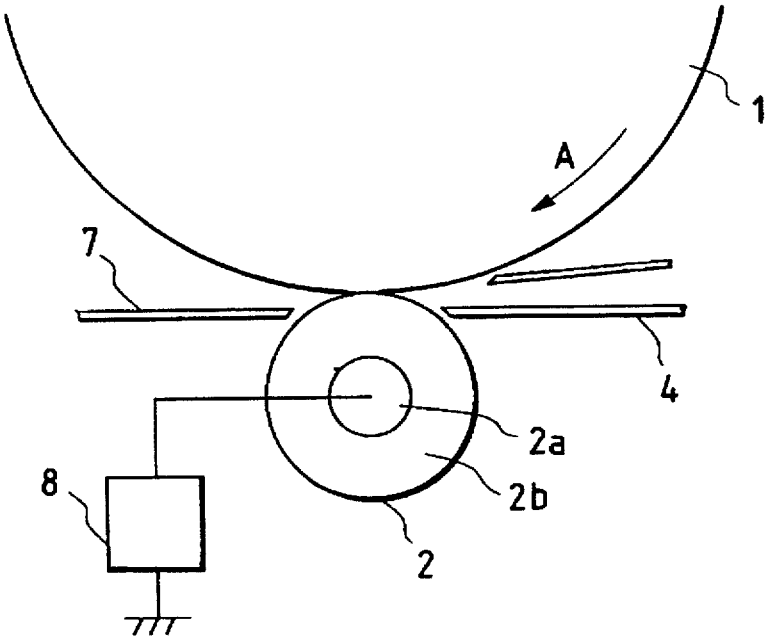
FIG. 3 is a schematic illustration of an electrostatic transfer assembly having a transfer roller.
Figure 4:
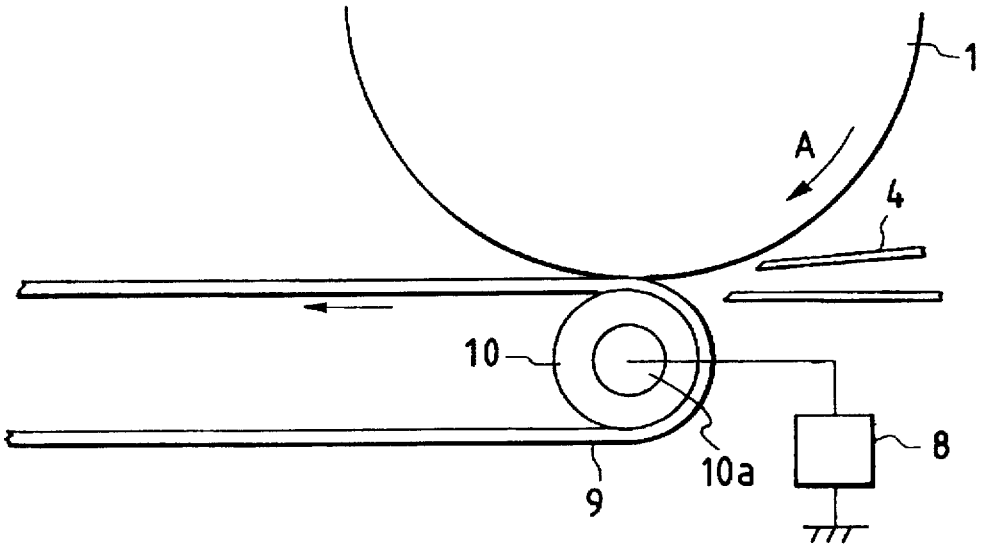
FIG. 4 is a schematic illustration of an electrostatic transfer assembly having a transfer belt.

FIG. 3 schematically illustrates a transfer roller, and FIG. 4 a transfer belt.

As a contact transfer assembly used in the image forming method to which the developer of the present invention is applied, there are the transfer roller as shown in FIG. 3 and the transfer belt as shown in FIG. 4. FIG. 3 is a schematic illustration of the main part of a typical image forming system of this type. The system shown therein comprises a latent image bearing member 1 (hereinafter often "photosensitive member 1") of a cylindrical form, which extends in the vertical direction as viewed on the paper surface and is rotatable in the direction of an arrow A, and a conductive transfer roller 2 provided in contact with the photosensitive member.

Around the photosensitive member 1, which is the latent image bearing member, members necessary for the image formation are provided, e.g., a primary corona assembly for uniformly charging the surface of the photosensitive member, an exposure zone in which an optical image of imagewise modulated laser light or light reflected from an original is projected on the charged surface and the potential at the corresponding portion is attenuated to form an electrostatic latent image, a developing assembly, a cleaner for removing the residual toner present on the surface of the photosensitive member after transfer, and other members, which, however, are omitted in FIGS. 3 and 4.

The transfer roller 2 has a mandrel 2*a* and a conductive elastic layer 2*b*. The conductive elastic layer 2*b* is made of an elastic material having a volume resistivity of $10^6$ to $10^{10}$ Ω·cm, such as a polyurethane resin or an ethylene-propylene-butadiene copolymer (EPDM), having a conductive material such as carbon dispersed therein. A bias is applied to the mandrel 2*a* through a constant voltage power source 8.

As conditions for the bias, a DC voltage of plus or minus 0.2 to plus or minus 10 kV is preferred. The transfer roller is brought into contact with the surface of the latent image bearing member at a contact pressure of from 1 to 300 g/cm (linear pressure), and preferably from 3 to 100 g/cm, and is rotated at a speed equal to, or different from, the peripheral speed of the latent image bearing member.

The linear pressure is calculated according to the following expression.

Linear pressure (g/cm)=Total pressure applied to transfer member (g)/Length of contact (cm)

If the contact pressure is less than 1 g/cm, faulty transfer tends to occur because of transfer deflection of the transfer member and shortage of transfer currents.

The developer of the present invention is particularly remarkably effective in a system where the transfer roller is rotated at a speed equal to that of the latent image bearing member.

FIG. 4 illustrates application of the transfer belt. A transfer belt 9 is driven while being supported by a conductive roller 10. The pressure to the transfer belt is usually applied by applying a pressure to end bearings of a mandrel 10*a* of the roller.

The present invention is particularly effective for an image forming system where the surface of the latent image bearing member 1 is formed of an organic compound such as resin. This is because, when the organic compound forms its surface layer, there is a problem that the organic compound tends to adhere to the binder resin contained in the toner and, especially when a material of the same quality is used, tends to cause chemical bonding at the contact point between the toner and the surface of the latent image bearing member, resulting in a lowering of transfer performance.

As a material to form the surface of the latent image bearing member, it may include silicone resins, vinylidene chloride resins, ethylene-vinylidene chloride resin, a styrene-acrylonitrile copolymer, a styrene-methyl methacrylate copolymer, styrene resins, polyethylene terephthalate resin, and polycarbonate resin. Examples are by no means limited to these, and copolymers or blends of other monomers or of some of the resins exemplified above may also be used. The present invention is effective especially when the surface is formed of polycarbonate resin, and is also effective especially when applied to an image forming system where the latent image bearing member 1 is a photosensitive drum having a diameter of 50 mm or smaller, and preferably 40 mm or smaller, e.g., from 25 to 35 mm.

This is because, when the photosensitive drum has a small diameter, the pressure tends to concentrate at the contact portion because of a great curvature even at a like linear pressure. The same phenomenon is considered to occur also in a belt type photosensitive member. Thus, the present invention is also effective for an image forming system having a belt type photosensitive member having a curvature of 25 mm or smaller at the transfer portion.

Figure 5:
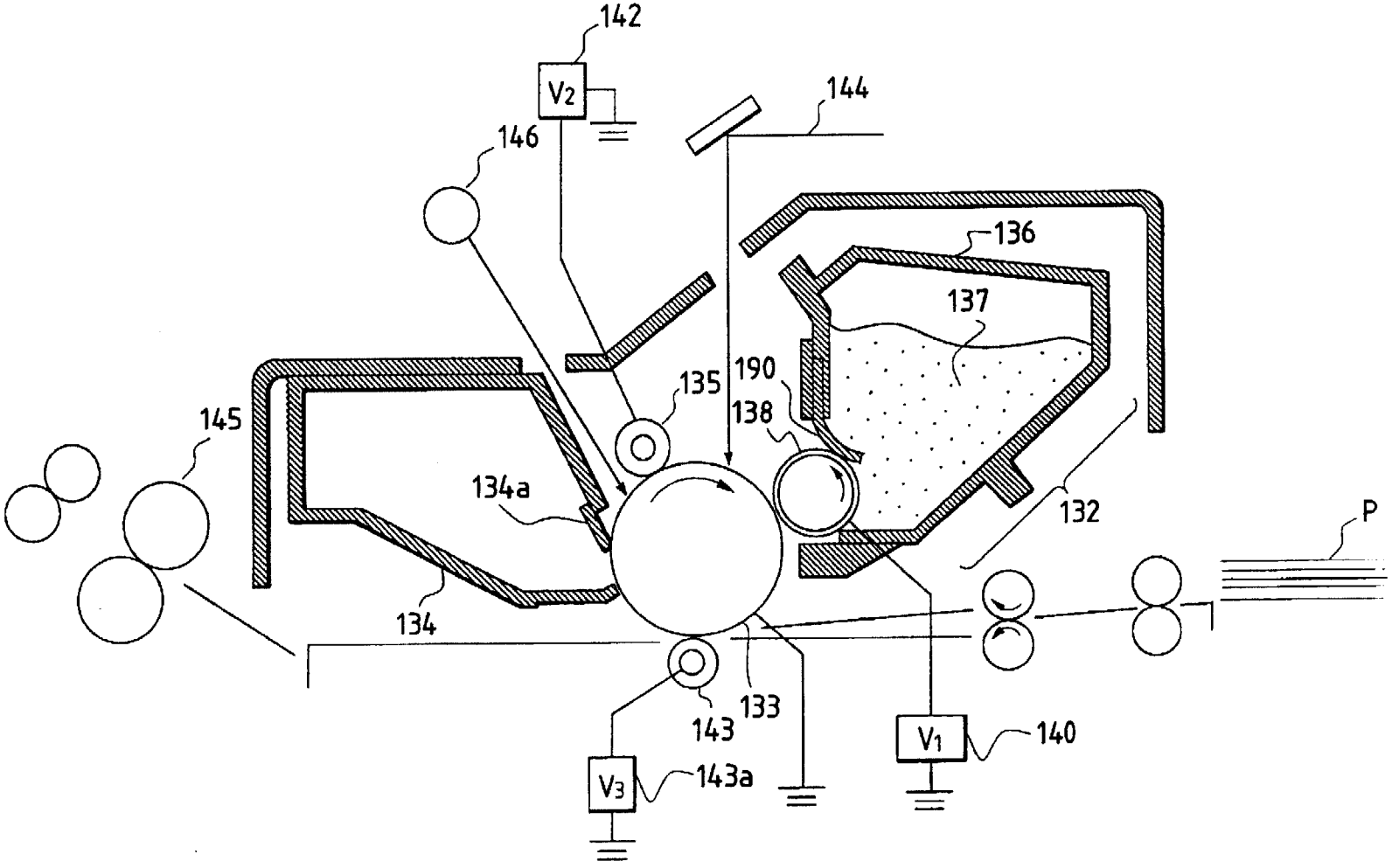
FIG. 5 is a schematic illustration of an image forming system equipped with a process unit having the developer of the present invention.

An image forming method to which the developer of the present invention can be preferably applied will be described with reference to FIG. 5.

The surface of a photosensitive member 133 is, for example, negatively charged by the operation of a charging roller 135, which is a primary corona assembly to which a bias V2 is applied from a bias applying means 142. The charged surface is exposed to light 144 to form an electrostatic image thereon. The electrostatic image thus formed is developed using a developer 137 comprising the magnetic toner and the aggregate, held in a developing assembly having an elastic blade made of urethane rubber and provided in the counter direction, and equipped with a developing sleeve 138 internally provided with a magnet. In the developing zone, a bias V1 comprising an alternating bias, a pulse bias and/or a DC bias is/are applied across a conductive substrate of the photosensitive drum 133 and the developing sleeve 138 through a bias applying means 140. Transfer paper P is fed and delivered to a transfer zone, where the transfer paper P is electrostatically charged from its back surface (the surface opposite to the photosensitive drum) through a contact transfer means 143 to which a bias V3 is applied from a bias applying means 143*a*, so that the developed image (toner image) on the surface of the photosensitive drum 133 is electrostatically transferred to the transfer paper P. The transfer paper P separated from the photosensitive drum 133 is subjected to fixing using a heat-pressure roller fixing assembly 145 so that the toner image on the transfer paper P can be fixed.

The magnetic toner remaining on the photosensitive drum after the transfer step is removed by the operation of a cleaning means 134 having a cleaning blade 134*a*. After the cleaning, the residual charges on the surface of the photosensitive drum 133 is eliminated by erase exposure 146, and thus the procedure again starting from the charging step using the charging roller 135 is repeated.

As the binder resin for the toner in the present invention, it is possible to use the following binder resin.

For example, usable ones are polystyrene; homopolymers of styrene derivatives such as poly-p-chlorostyrene and polyvinyltoluene; styrene copolymers such as a styrene-p-chlorostyrene copolymer, a styrene-vinyltoluene copolymer, a styrene-vinylnaphthalene copolymer, a styrene-acrylate copolymer, a styrene-methacrylate copolymer, a styrene-methyl α-chloromethacrylate copolymer, a styrene-acrylonitrile copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer and a styrene-acrylonitrile-indene copolymer; polyvinyl chloride, phenol resins, natural resin modified phenol resins, natural resin modified maleic acid resins, acrylic resins, methacrylic resins, polyvinyl acetate, silicone resins, polyester resins, polyurethane resins, polyamide resins, furan resins, epoxy resins, xylene resins, polyvinyl butyral, terpene resins, cumarone indene resins, and petroleum resins. Preferred binder resins are styrene copolymers or polyester resins.

Comonomers copolymerizable with styrene monomers in the styrene copolymers may include monocarboxylic acids having a double bond and derivatives thereof as exemplified by acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile and acrylamide; dicarboxylic acids having a double bond and derivatives thereof as exemplified by maleic acid, butyl maleate, methyl maleate and dimethyl maleate; vinyl esters as exemplified by vinyl chloride, vinyl acetate and vinyl benzoate; ethylenic olefins as exemplified by ethylene, propylene and butylene; vinyl ketones as exemplified by methyl vinyl ketone and hexyl vinyl ketone; and vinyl ethers as exemplified by methyl vinyl ether, ethyl vinyl ether and isobutyl vinyl ether. Any of these vinyl monomers may be used alone or in combination of two or more kinds.

The styrene polymers or styrene copolymers may be cross-linked or may be in the form of mixed resins.

As a cross-linking agent of the binder resin, compounds having at least two polymerizable double bonds may be chiefly used. For example, they include aromatic divinyl compounds such as divinyl benzene and divinyl naphthalene; carboxylic acid esters having two double bonds, such as ethylene glycol diacrylate, ethylene glycol dimethacrylate and 1,3-butanediol dimethacrylate; divinyl compounds such as divinyl aniline, divinyl ether, divinyl sulfide and divinyl sulfone; and compounds having at least three vinyl groups. Any of these may be used alone or in the form of a mixture.

In bulk polymerization, low-molecular weight polymers can be obtained by carrying out the polymerization at a high temperature and accelerating the rate of termination reaction. There, however, a problem of a difficulty in reaction control. In solution polymerization, low-molecular weight polymers can be readily obtained under mild conditions by utilizing a difference in chain transfer of radicals, ascribable to solvents, and controlling the amount of initiators and the reaction temperature. Thus the latter is preferred when a low-molecular weight component is formed in the resin composition used in the toner of the present invention.

As solvents used in the solution polymerization, xylene, toluene, cumene, cellosolve acetate, isopropyl alcohol, benzene or the like may be used. In the case of a mixture of styrene monomer, xylene, toluene or cumene is preferred. The solvent may be appropriately selected according to the polymers to be produced by polymerization.

Reaction temperature may vary depending on the solvents to be used, initiators, and polymers to be produced. The reaction may preferably be carried out at 70° C. to 230° C. The solution polymerization may preferably be carried out using the monomers in an amount of from 30 parts by weight to 400 parts by weight based on 100 parts by weight of the solvent.

Other polymer(s) may also preferably be mixed in the solution when polymerization is completed, whereby several kinds of polymers can be well mixed.

As methods for obtaining high-molecular weight components or gel components, emulsion polymerization and suspension polymerization are preferred.

Of these, the emulsion polymerization is a method in which monomers almost insoluble in water are dispersed in an aqueous phase in the form of small particles by the use of an emulsifying agent and then polymerized using a water-soluble polymerization initiator. In this method, the heat of reaction can be readily controlled and the phase where polymerization takes place (an oily phase comprised of polymers and monomers) and the aqueous phase are separated, so that the rate of termination reaction can be low and hence the rate of polymerization can be high, making it possible to obtain a product with a high degree of polymerization. In addition, because of a relative simple polymerization process and also because of a polymerization product formed of fine particles, the product can be readily mixed with colorants, charge control agents and other additives in the manufacture of toners, and hence this method is more advantageous than other methods, as a method of producing binder resins for toners.

The emulsion polymerization, however, tends to give an impurity to the resulting polymer because of an emulsifying agent added, and also requires operations such as salting-out to take out the polymer. Hence, the suspension polymerization is a simple and preferred method.

The suspension polymerization may be carried out using monomers in an amount of not more than 100 parts by weight, and preferably from 10 to 90 parts by weight, based on 100 parts by weight of a water-based solvent. Usable dispersants may include polyvinyl alcohol, a polyvinyl alcohol partially saponified product, and calcium phosphate. Usually, any of these dispersants may be used in an mount of from 0.05 to 1 part by weight based on 100 parts by weight of the water-based solvent. The polymerization may be suitably carried out at a temperature of from 50 to 95° C., which should be appropriately selected according to polymerization initiators to be used and the intended polymer. Any types of polymerization initiators can be used so long as they are insoluble or sparingly insoluble in water.

The polymerization initiator used may include t-butylperoxy-2-ethylhexanoate, cumine perpivalate, t-butylperoxylaurate, benzoyl peroxide, lauroyl peroxide, octanoyl peroxide, di-t-butyl peroxide, t-butylcumyl peroxide, dicumyl peroxide, 2,2'-azobis(2-isobutyronitrile), 2,2'-azobis(2-methylbutyronitrile), 2,2'-azobis(2,4-dimethylvaleronitrile), 2,2'-azobis(4-methoxy-2,4-dimethylvaleronitrile), 1,1-bis(t-butylperoxy)-3,3,5-trimethylcyclohexane, 1,1-bis(t-butylperoxy)cyclohexane, 1,4-bis(t-butylperoxycarbonyl)cyclohexane, 2,2-bis(t-butylperoxy)octane, n-butyl-4,4-bis(t-butylperoxy)valylate, 2,2-bis(t-butylperoxy)butane, 1,3-bis(t-butylperoxy-isopropyl)benzene, 2,5-dimethyl-2,5-di(t-butylperoxy) hexane, 2,5-dimethyl-2,5-di(t-butylperoxy)hexyne, 2,5-dimethyl-2,5-di(benzoylperoxy)hexane, di-t-butylperoxyisophthalate, 2,2-bis(4,4-di-t-butylperoxycyclohexyl)propane, di-t-butylperoxy-α-methylsuccinate, di-t-butylperoxydimethylglutarate, di-t-butylperoxyhexahydroterephthalate, di-t-butylperoxyazelate, 2,5-diemthyl-2,5-di(t-butylperoxy) hexane, diethylene glycol-bis(t-butylperoxycarbonate), di-t-butylperoxytrimethyladipate, tris(t-butylperoxy)triazine, and vinyl tris(t-butylperoxy)silane. Any of these may used alone or in combination.

The initiator may be used in an amount of not less than 0.05 part by weight, and preferably from 0.1 part by weight to 15 parts by weight, based on 100 parts by weight of the monomers.

When the binder resin of the toner used in the present invention is a polyester resin, the polyester resin may preferably have the composition as shown below.

As a dihydric alcohol component, it may include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, a bisphenol and derivative thereof represented by the following Formula (A);

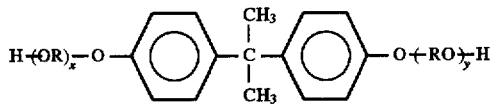

(A)

wherein R represents an ethylene group or a propylene group, x and y are each an integer of 0 or more, and an average value of x+y is 0 to 10; and a diol represented by the following Formula (B).

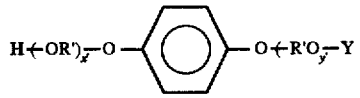

(B)

wherein R' represents

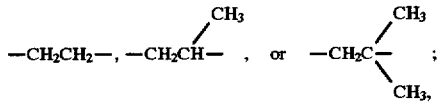

x' and y' are each an integer of 0 or more, and an average value of x'+y' is 0 to 10.

As a dibasic acid component, it may include dicarboxylic acids and derivatives thereof as exemplified by benzene dicarboxylic acids such as phthalic acid, terephthalic acid, isophthalic acid and phthalic anhydride, and anhydrides or lower alkyl esters thereof; alkyldicarboxylic acids such as succinic acid, adipic acid, sebacic acid and azelaic acid, and anhydrides or lower alkyl esters thereof; alkenylsuccinic acids or alkylsuccinic acids such as n-dodecenylsuccinic acid and n-dodecylsuccinic acid, and anhydrides or lower alkyl esters thereof; unsaturated dicarboxylic acids such as fumaric acid, maleic acid, citraconic acid and itaconic acid, and anhydrides or lower alkyl esters thereof.

A trihydric or higher alcohol component and a tribasic or higher acid component serving also as cross-linking components may also be used in combination.

The trihydric or higher, polyhydric alcohol component may include sorbitol, 1,2,3,6-hexanetetrol, 1,4-sorbitan, pentaerythritol, dipentaerythfitol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxybenzene.

The tribasic or higher, polycarboxylic acid component in the present invention may include trimellitic acid, pyromellitic acid, 1,2,4-benzenetricarboxylic acid, 1,2,5-benzenetricarboxylic acid, 2,5,7-naphthalenetri-carboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra (methylenecarboxyl)methane, 1,2,7,8-octanetetracarboxylic acid, Empol trimer acid, anhydrides of these, and lower alkyl esters of these. It may also include a tetracarboxylic acid represented by the formula:

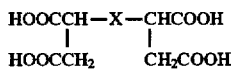

wherein X represents an alkylene group or alkenylene group having 5 to 30 carbon atoms having at least one side chain having 3 or more carbon atoms; anhydrides thereof, and lower alkyl esters thereof.

The alcohol component may be used in an amount of from 40 to 60 mol %, and preferably from 45 to 55 mol %; and the acid component, from 60 to 40 mol %, and preferably from 55 to 45 mol %.

The trihydric or higher, polyhydric and polybasic components may preferably be in an amount of from 5 to 60 mol % of the whole components.

From the viewpoint of developing performance, fixing performance, running performance and cleaning performance, it is preferable to use a styrene/unsaturated carboxylic acid derivative copolymer, a polyester resin, a block copolymer of these, a grafted product of these, or a mixture of a styrene copolymer and a polyester resin.

The binder resin of the toner may preferably have, in molecular weight distribution as measured by gel permeation chromatography (GPC), a peak in the region of molecular weight of not less than 100,000 and also another peak in the region of molecular weight of from 3,000 to 50,000. This is preferable in view of fixing performance and running performance.

Such a binder resin can be obtained using, for example, the method as describe below.

Polymer (L) having a main peak in the region of molecular weight of from 3,000 to 50,000 and polymer (H) containing a polymer or gel component having a main peak in the region of molecular weight of not less than 100,000 are each prepared using solution polymerization, bulk polymerization, suspension polymerization, emulsion polymerization, block polymerization or grafting. Then these components are blended during melt kneading to obtain the binder resin. Part or the whole of the gel component can be cut during the melt kneading, and comes to be a tetrahydrofuran(THF)-soluble matter and measurable as the component in the region of molecular weight of not less than 100,000.

Particularly preferred methods may include a method in which one of polymer (L) and polymer (H) is prepared by solution polymerization and is blended with the other when polymerization is completed, a method in which one of the polymers is polymerized in the presence of the other polymer, a method in which polymer (H) is formed by suspension polymerization and polymer (L) is prepared by solution polymerization in the presence of the polymer (H), a method in which polymer (H) is blended in a solvent when solution polymerization for polymer (L) is completed, and a method in which polymer (H) is prepared by suspension polymerization in the presence of polymer (L). Use of any of these methods can give a polymer comprised of a low-molecular weight component and a high-molecular weight component which are uniformly mixed.

In the case of a positively chargeable toner, a styrene-acrylic copolymer, a styrene-methacrylic-acrylic copolymer, a styrene-methacrylic copolymer, a styrene-butadiene copolymer, a polyester resin having an acid value of 10 or less, and a block copolymer, grafted product or blended resin of any of these are preferable. In the case of a negatively chargeable toner, a styrene-acrylic copolymer, a styrene-methacrylic-acrylic copolymer, a styrene-methacrylic copolymer, a copolymer of any of these with maleic monoester, a polyester resin, and a block copolymer, grafted product or blended resin of any of these are preferable in view of developing performance.

As a binder resin for the toner used in a pressure fixing system, it may include low-molecular weight polyethylene, low-molecular weight polypropylene, an ethylene-viny acetate copolymer, and ethylene-acrylic ester copolymer, higher fatty acids, polyamide resins, and polyester resins. These may be used alone or in the form of a mixture.

From the viewpoint of an improvement in releasability from a fixing member at the time of fixing and an improvement in fixing performance, it is also preferable to incorporate into toner particles any of the following waxes as a release agent.

They are paraffin wax and derivatives thereof, montan wax and derivatives thereof, microcrystalline wax and derivatives thereof, Fischer-Tropsch wax and derivatives thereof, polyolefin wax and derivatives thereof and carnauba wax and derivatives thereof. The derivatives may include oxides, block copolymers with vinyl monomers, and graft-modified products.

As other release agents, it is also possible to use alcohols, fatty acids, acid amides, esters, ketones, hardened castor oil and derivatives thereof, vegetable waxes, animal waxes, mineral waxes and petrolactams.

In particular, waxes preferably usable are low-molecular weight polyolefins obtained by radical polymerization of olefins under a high pressure or polymerization thereof in the presence of a Ziegler catalyst, and by-products from the polymerization; low-molecular weight polyolefins obtained by thermal decomposition of high-molecular weight polyolefins; and waxes obtained from distillation residues of polymethylene hydrocarbons obtained from a synthetic gas comprised of carbon monoxide and hydrogen, in the presence of a catalyst, or synthetic hydrocarbons obtained by hydrogenation of these. An antioxidant may also be added. The wax may also include straight-chain alcohols, acid amides, esters or montan type derivatives. Those from which impurities such as fatty acids have been removed are also preferred.

Particularly preferred are those obtained by polymerization of olefins such as ethylene in the presence of a Ziegler catalyst, and by-products from the polymerization, and those basically composed of hydrocarbons having up to thousands of carbon atoms, in particular, about a thousand of carbon atoms, such as Fischer-Tropsch wax.

From these waxes, waxes may be fractionated according to the size of molecular weight by press sweating, solvent fractionation, vacuum distillation, ultracritical gas extraction or fractionation recrystallization (e.g., molten liquid crystallization and crystal filtration). Such waxes may be used. After the fractionation, oxidation, block copolymerization or graft modification may be carried out. Using these processes, waxes can be made to have any desired molecular weight distribution by, for example, removing low-molecular weight components, or extracting low-molecular weight components, and further removing low-molecular weight components from these products.

The waxes having been subjected to fractionation according to the size of molecular weight are particularly preferred since they may less affect triboelectric charging and do not adversely affect developing performance.

The wax may preferably have a melting point of from 70° to 155° C. and a melt viscosity of 500 cP or below at 160° C., more preferably have a melting point of from 75° to 145° C. and a melt viscosity of 1,000 cP or below at 140° C., and still more preferably have a melting point of from 80° to 135° C. and a melt viscosity of 500 cP or below at 140° C.

As a magnetic powder used in the case of magnetic toners, a powder of an alloy or compound containing a ferromagnetic element is preferably used. For example, it may include alloys or compounds of iron, cobalt, nickel, manganese, zinc of the like, such as magnetite, maghematite and ferrite, and other materials hitherto known as magnetic materials, such as ferromagnetic alloys.

Magnetic particles containing on the surfaces or insides thereof a compound such as an oxide, hydrous oxide, hydroxide or the like of metals ions such as Si, Al or Mg may be used.

Magnetic particles on or to the surfaces of which an organic compound such as a coupling agent, a fatty acid compound or a resin has been reacted, adsorbed or caused to adhere may be used.

As to the shape of the magnetic particles, they may be octahedral, hexahedral, spherical, acicular or flaky.

The magnetic powder may preferably have a BET specific surface area as measured using nitrogen gas adsorption, of from 1 $m^2/g$ to 40 $m^2/g$, and more preferably from 2 $m^2/g$ to 30 $m^2/g$.

The magnetic powder may preferably have a saturation magnetization in the range of from 5 emu/g to 200 emu/g, and more preferably from 10 emu/g to 150 emu/g, under application of a magnetic field of 10k oersted.

The magnetic powder may preferably have a residual magnetization of from 1 emu/g to 100 emu/g, and more preferably from 1 emu/g to 70 emu/g, under application of a magnetic field of 10k oersted.

The magnetic powder may preferably have an average particle diameter of from 0.05 to 1.0 μm, more preferably from 0.1 to 0.6 μm, and still more preferably from 0.1 to 0.4 μm.

The magnetic powder may preferably be contained in the toner in an amount of from 5 to 200 parts by weight, and more preferably from 10 to 150 parts by weight, based on 100 parts by weight of the binder resin. If it is in an amount less than 5 parts by weight, the toner may have a small magnetizing force to tends to cause fog and black spots around line images. If it is in an amount more than 200 parts by weight, the fixing performance tends to be damaged.

In order to sharpen the distribution of charge quantity, it is preferable to add to the toner the following charge control agent. The charge can be controlled by selecting the type and amount of the compound to be added, in accordance with other component materials.

A charge control agent capable of controlling the toner to be positively chargeable includes the following materials.

Nigrosine and products modified with a fatty acid metal salt; quaternary ammonium salts such as tributylbenzylammonium 1-hydroxy-4-naphthosulfonate and tetrabutylammonium teterafluoroborate, and analogues of these, i.e., onium salts such as phosphonium salts, and lake pigments of these, triphenylmethane dyes and lake pigments of these (laking agents include tungstophosphoric acid, molybdophosphoric acid, tungstomolybdophosphoric acid, tannic acid, lauric acid, gallic acid, ferricyanic acid and ferrocyanic acid), and metal salts of higher fatty acids; diorganotin oxides such as dibutyltin oxide, dioctyltin oxide and dicyclohexyltin oxide; and diorganotin borates such as dibutyltin borate, dioctyltin borate and dicyclohexyltin borate; guanidine compounds, and imidazole compounds. Any of these may be used alone or in combination of two or more kinds. Of these, triphenylmethane dyes compounds and quaternary ammonium salts whose counter ions are not halogens may preferably be used. Homopolymers of monomers represented by the following Formula (1);

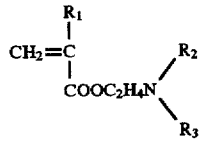

(1)

wherein $R_1$ represents H or $CH_3$; $R_2$ and $R_3$ each represent a substituted or unsubstituted alkyl group (preferably having 1 to 4 carbon atoms); or copolymers of polymerizable monomers such as styrene, acrylates or methacrylates as described above may also be used as positive charge control agents. In this case, these charge control agents can also act as binder resins (as a whole or in part).

A charge control agent capable of controlling the toner to be negatively chargeable includes the following materials.

For example, organic metal complex salts and chelate compounds are effective, including monoazo metal complexes, acetylacetone metal complexes, aromatic hydroxycarboxylic acid and aromatic dicarboxylic acid type metal complexes. Besides, they also include aromatic hydroxycarboxylic acid, aromatic mono- and polycarboxylic acids, and metal salts, anhydrides or esters thereof, and phenol derivatives such as bisphenol.

Azo type metal complexes represented by Formula (3) shown below are preferred.

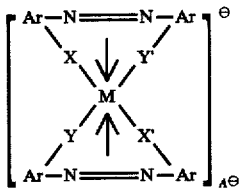

(3)

In the formula, M represents a central metal of coordination, as exemplified by Sc, Ti, V, Cr, Co, Ni, Mn or Fe. Ar represents an aryl group as exemplified by a phenyl group or a naphthyl group, which may have a substituent. In such a case, the substituent includes a nitro group, a halogen atom, a carboxyl group, an anilido group, and an alkyl group or alkoxyl group having 1 to 18 carbon atoms. X, X', Y and Y' each represent —O—, —CO—, —NH— or —NR— (R is an alkyl group having 1 to 4 carbon atoms). $A^+$ represents hydrogen, sodium, potassium, ammonium or aliphatic ammonium. As the central metal, Fe or Cr is particularly preferred. As the substituent, a halogen atom, an alkyl group or an anilido group is preferred. As counter ions, hydrogen, ammonium or aliphatic ammonium is preferred.

Basic organic acid metal complex salts represented by Formula (4) shown below are also capable of imparting negative chargeability, and may be used in the present invention.

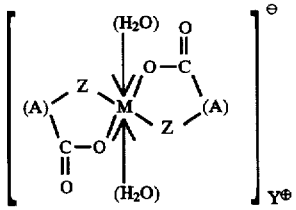

(4)

In the formula, M represents a central metal of coordination, as exemplified by Cr, Co, Ni, Mn, Fe, Zn, Al, Si or B. A represents;

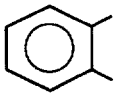

(which may have a substituent such as an alkyl group)

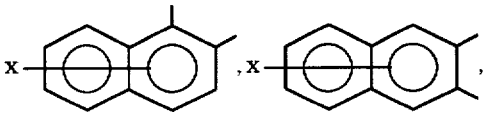

-continued

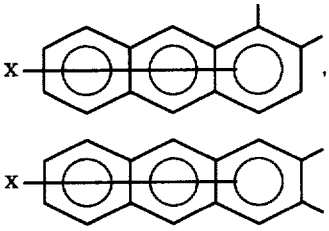

(X represents a hydrogen atom, a halogen atom or a nitro group), and

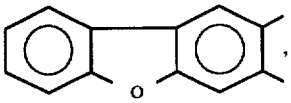

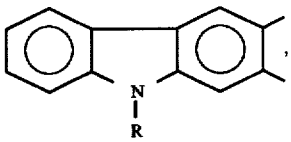

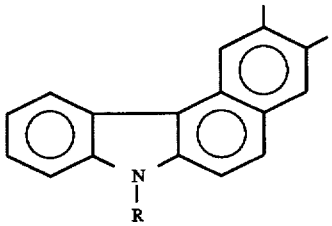

(R represents a hydrogen atom, an alkyl group or alkenyl group having 1 to 18 carbon atoms); $Y^+$ represents hydrogen, sodium, potassium, ammonium, aliphatic ammonium or nothing. Z represents —O— or

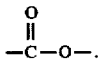

As the central metal, Fe or Cr is particularly preferred. As the substituent, an alkyl group, an aryl group or a halogen atom is preferred. As counter ions, hydrogen, ammonium or aliphatic ammonium is preferred.

As methods for making toner particles hold the charge control agent, there are a method of internally adding it into the toner particles and a method of externally adding it to the toner particles. The amount of the charge control agent used depends on the type of the binder resin, the presence of any other additives, and the manner by which the toner is produced, including the manner of dispersion, and can not be absolutely specified. Preferably, the charge control agent may be used in an amount ranging from 0.1 to 10 parts by weight, and more preferably from 0.1 to 5 parts by weight, based on 100 parts by weight of the binder resin. When externally added to toner particles, it may preferably be added in an amount of from 0.01 to 10 parts by weight based on 100 parts by weight of the binder resin, and especially may preferably be made to mechanochemically adhere to the surfaces of toner particles.

The toner used in the developer of the present invention may preferably have a weight average particle diameter of from 3 to 15 μm, and more preferably from 4 to 9 μm. Such a toner is preferred in view of definition performance and suitable aggregativity.

As a colorant, it is possible to use hitherto known inorganic or organic dyes or pigments. For example, it includes carbon black, Aniline Black, acetylene black, Naphthol Yellow, Hansa Yellow, Rhodamine Lake, Alizarine Lake, red iron oxide, Phthalocyanine Blue and Indanethrene Blue. Any of these may be used usually in an amount of from 0.5 to 20 parts by weight based on 100 parts by weight of the binder resin.

To produce the toner, it is preferable to use a method in which the toner component materials as described above are thoroughly mixed by means of a mixer such as a ball mill, thereafter the mixture obtained is well kneaded by means of a heat kneader such as a heat roll kneader or an extruder, and the kneaded product is cooled to solidify, followed by mechanical pulverization and classification of the pulverized product to obtain a toner. As other methods, there are a method in which the component materials are dispersed in a solution of a binder resin and thereafter the dispersion obtained is spray-dried to obtain a toner; and a method for producing a toner by polymerization in which given. materials are mixed with monomers that will constitute a binder resin to form an emulsion suspension, followed by polymerization. The toner may be a microcapsule toner comprised of a core material and a shell material.

The toner is further thoroughly blended with the aggregate by means of a mixer such as a Henschel mixer, so that the developer of the present invention can be obtained.

In order to impart preferable charging performance, running performance, cleaning performance and fluidity to the toner, it is also preferable to externally add and mix the following materials.

Such materials include inorganic fine powders as exemplified by finely divided silicas such as wet-process silica and dry-process silica; treated silicas obtained by subjecting such silica to surface treatment using a silane coupling agent, a titanium coupling agent or a silicone oil; metal oxides such as alumina, titanium oxide (titania), germanium oxide and zirconium oxide; carbides such as silicon carbide and titanium carbide; and nitrides such as silicon nitride and germanium nitride.

The inorganic fine powder used in the present invention may be added in an amount of from 0.01 to 8 parts by weight, and preferably 0.1 to 4 parts by weight, based on 100 parts by weight of the toner.

Preferably, a fine silica powder or a fine titanium oxide powder having a BET specific surface area of 30 $m_2/g$ or more, and particularly in the range of from 50 to 400 $m^2/g$, as measured by nitrogen adsorption according to the BET method, gives good results when used in combination with the aggregate of fine particles. The fine silica powder or fine titanium oxide powder may be used in an amount of from 0.01 to 8 parts by weight, and preferably from 0.1 to 5 parts by weight, based on 100 parts by weight of the toner.

For the purpose of making hydrophobic and controlling chargeability, the fine silica powder used in the present invention may also preferably have been optionally treated with a small quantity of a treating agent such as a silicone varnish, a modified silicone varnish of various types, a silicone oil, a modified silicone oil of various types, a silane coupling agent, a silane coupling agent having a functional group or other organic silicon compound, or with various treating agents used in combination.

Also when surface-treated, the fine silica powder or fine titanium oxide powder may preferably have a BET specific surface area of 30 $m^2/g$ or more, and particularly from 50 to 400 $m^2/g$ In order to improve developing performance and running performance, it is also preferable to add the following inorganic powder. It may include oxides of metals such as magnesium, zinc, aluminum, cerium, cobalt, iron, zirconium, chromium, manganese, strontium, tin and antimony; composite metal oxides (double oxides) such as calcium titanate, magnesium titanate and strontium titanate; metal salts such as calcium carbonate, magnesium carbonate and aluminum carbonate; clay minerals such as kaolin; phosphoric acid compounds such as apatite; silicon compounds such as silicon carbide and silicon nitride; and carbon powders such as carbon black and graphite powder. In particular, zinc oxide, aluminum oxide, cobalt oxide, manganese dioxide, strontium titanate or magnesium titanate is preferred.

For the same purpose, it is also preferable to add the following organic particles or composite particles. They may include resin particles such as polyamide resin particles, silicone resin particles, urethane resin particles, melamine-formaldehyde resin particles and acrylic resin particles; and composite particles of any of rubber, wax, fatty acid compound, resin, metal, metal oxide, salt, carbon black, etc.

A lubricant powder as shown below may also be added. It may include fluorine resins such as Teflon and polyvinylidene fluoride; fluorine compounds such as carbon fluoride; fatty acid metal salts such as zinc stearate; fatty acids, and fatty acid derivatives such as fatty acid esters; molybdenum sulfide; amino acid, and amino acid derivatives.

As a carrier used in two-component development, it is possible to use hitherto known carriers. Stated specifically, particles of metals such as iron, nickel, cobalt, manganese, chromium and rare earth elements, and alloys or oxides thereof, having been surface-oxidized or unoxidized and having an average particle diameter of from 20 to 300 μm, may be used.

It is preferable to use carriers comprising such carrier particles to or on the surfaces of which a material such as a styrene resin, an acrylic resin, a silicone resin, a fluorine resin or a polyester resin has been made to adhere or coated.

Production examples of the aggregate formed of the silicone oil or silicone varnish and the fine particles will be described below.

Aggregate No. 1

Fine silicon oxide particles (BET specific surface area: 200 $m^2/g$) synthesized by the dry process were put in an internal type Henschel mixer heated to 80° C., and then agitated at a high speed while spraying dimethylsilicone oil (viscosity at 25° C.: 12,000 centistokes) diluted with alcohol so as to be treated in a quantity of 150 parts by weight based on 100 parts by weight of the fine silicon oxide particles. Thus, aggregate No. 1, containing 60% by weight of dimethylsilicone oil and having a BET specific surface area of 2.5 $m^2/g$, was obtained.

Aggregate No. 2

Aggregate No. 2, having a BET specific surface area of 2.2 $m^2/g$, was obtained in the same manner as the production of aggregate No. 1 except that fine silicon oxide particles (BET specific surface area: 200 $m^2/g$) synthesized by the dry process and whose surfaces were made hydrophobic using a silane coupling agent were used as the fine particles.

Aggregates Nos. 3 to 6

Aggregates Nos. 3 to 6 were obtained in the same manner as the production of aggregate No. 1 except that those shown in Table 1 were used as the fine particles.

Aggregates Nos. 7 to 10

Aggregates Nos. 7 to 10 were obtained in the same manner as the production of aggregate No. 1 except that dimethylsilicone oils shown in Table 1, each having a different viscosity, were used as the silicone oil.

Aggregates Nos. 11 to 14

Aggregates Nos. 11 to 14 were obtained in the same manner as the production of aggregate No. 1 except that as the silicone oil an amino-modified silicone oil (viscosity: 3,500 centistokes; amine value: 2,000) was used in the amount shown in Table 2.

Aggregates Nos. 15 and 16

Aggregates Nos. 15 and 16 were obtained in the same manner as the production of aggregates Nos. 11 to 14 except that silica made hydrophobic using an aminosilane coupling agent was used as the fine particles.

Aggregates Nos. 17 to 20

Aggregates Nos. 17 to 20, having different BET specific surface areas, were obtained in the same manner as the production of aggregate No. 7 except the the conditions for spraying dimethylsilicone oil and conditions for agitation when the aggregates were produced were changed and the dimethylsilicone oil was used in an amount of 100 parts by weight.

Comparative Aggregate Nos. 1 and 2

Comparative aggregates Nos. 1 and 2 were obtained in the same manner as the production of aggregate No. 1 except that a silicone oil (viscosity: 3,500 centistokes) was used in the amount shown in Table 2.

TABLE 1

| | Fine particles | | Silicone oil | | | Aggregate | |
|---|---|---|---|---|---|---|---|
| Aggregate No. | Type | BET specific surface area ($m^2/g$) | Type | Viscosity (cs) | Amount (wt. %) | BET specific surface area ($m^2/g$) | Chloroform dissolution (wt. %) |
| 1 | Silica | 200 | Dimethylsilicone oil | 12,000 | 60 | 2.5 | 55 |
| 2 | Hydrophobic treated silica | 200 | Dimethylsilicone oil | 12,000 | 60 | 2.2 | 58 |
| 3 | Alumina | 120 | Dimethylsilicone oil | 12,000 | 60 | 1.2 | 58 |
| 4 | Titanium oxide | 100 | Dimethylsilicone oil | 12,000 | 60 | 1.1 | 58 |
| 5 | Silica | 300 | Dimethylsilicone oil | 12,000 | 60 | 3.8 | 52 |
| 6 | Silica | 130 | Dimethylsilicone oil | 12,000 | 60 | 1.8 | 57 |
| 7 | Silica | 200 | Dimethylsilicone oil | 100 | 60 | 6.2 | 58 |
| 8 | Silica | 200 | Dimethylsilicone oil | 1,000 | 60 | 4.3 | 57 |
| 9 | Silica | 200 | Dimethylsilicone oil | 3,500 | 60 | 3.1 | 56 |
| 10 | Silica | 200 | Dimethylsilicone oil | 60,000 | 60 | 2.0 | 54 |

TABLE 2

| | Fine particles | | Silicone oil | | | Aggregate | |
|---|---|---|---|---|---|---|---|
| | Type | BET specific surface area ($m^2/g$) | Type | Viscosity (cs) | Amount (wt. %) | BET specific surface area ($m^2/g$) | Chloroform dissolution (wt. %) |
| Aggregate No.: | | | | | | | |
| 11 | Silica | 200 | Amino-modified silicone oil* | 3,500 | 30 | 5.7 | 27 |
| 12 | Silica | 200 | Amino-modified silicone oil* | 3,500 | 42 | 4.1 | 40 |
| 13 | Silica | 200 | Amino-modified silicone oil* | 3,500 | 60 | 3.2 | 57 |
| 14 | Silica | 200 | Amino-modified silicone oil* | 3,500 | 80 | 0.8 | 76 |
| 15 | Silica made hydrophobic** | 200 | Amino-modified silicone oil* | 3,500 | 42 | 3.8 | 40 |
| 16 | Silica made hydrophobic** | 200 | Amino-modified silicone oil* | 3,500 | 60 | 2.9 | 56 |
| 17 | Silica | 200 | Dimethylsilicone oil | 100 | 50 | 8.5 | 48 |
| 18 | Silica | 200 | Dimethylsilicone oil | 100 | 50 | 25 | 47 |
| 19 | Silica | 200 | Dimethylsilicone oil | 100 | 50 | 40 | 46 |
| 20 | Silica | 200 | Dimethylsilicone oil | 100 | 50 | 70 | 44 |
| Comparative Aggregate No.: | | | | | | | |
| 1 | Silica | 200 | Dimethylsilicone oil | 3,500 | 19 | 45 | 18 |
| 2 | Silica | 200 | Dimethylsilicone oil | 3,500 | 91 | 0.1 | 87 |

*(amine value: 2,000)
**with aminosilane coupling agent

Production examples of the toner will be described below.

| Magnetic Toner No. 1 | (by weight) |
|---|---|
| Styrene/butyl acrylate/monobutyl maleate copolymer (weight average molecular weight: 40,000) | 100 parts |
| Magnetic iron oxide (average particle diameter: 0.2 μm) | 100 parts |
| Low-molecular weight polypropylene (release agent) | 4 parts |
| Monoazo iron complex (negative charge control agent) | 1 part |

The above materials were premixed, and then the mixture was melt-kneaded using a twin-screw extruder set at 130° C. The kneaded product thus obtained was cooled and then crushed. The crushed product was finely pulverized by means of a grinding mill making use of a jet stream. Subsequently, the finely pulverized powder thus obtained was classified using an air classifier to obtain a classified powder (magnetic toner No. 1) with a weight average particle diameter of 7.0 μm.

| Magnetic Toner No. 2 | (by weight) |
|---|---|
| Styrene-butyl acrylate copolymer (weight average molecular weight: 40,000) | 100 parts |
| Magnetic iron oxide (average particle diameter: 0.2 μm) | 80 parts |
| Hydrocarbon wax (release agent) | 4 parts |
| Triphenylmethane compound (positive charge control agent) represented by the formula shown below | 2 parts |

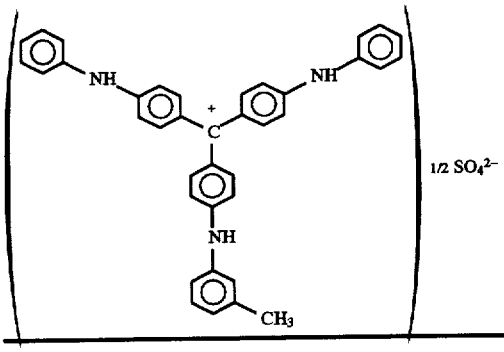

The above materials were premixed, and then the mixture was melt-kneaded using a twin-screw extruder set at 130° C. The kneaded product thus obtained was cooled and then crushed. The crushed product was finely pulverized by means of a grinding mill making use of a jet stream. Subsequently, the finely pulverized powder thus obtained was classified using an air classifier to obtain a classified powder (magnetic toner No. 2) with a weight average particle diameter of 8.5 μm.

| Non-magnetic Toner No. 1 | (by weight) |
|---|---|
| Styrene/butyl acrylate/dimethylaminoethyl acrylate copolymer (weight average molecular weight: 15,000) | 75 parts |
| Styrene/butadiene copolymer (weight average molecular weight: 200,000) | 25 parts |
| Low-molecular weight polypropylene (release agent) | 4 parts |
| Red insoluble azo pigment | 5 parts |

The above materials were premixed, and then the mixture was melt-kneaded using a twin-screw extruder set at 130° C. The kneaded product thus obtained was cooled and then crushed. The crushed product was finely pulverized by means of a grinding mill making use of a jet stream. Subsequently, the finely pulverized powder thus obtained was classified using an air classifier to obtain a classified powder (nonmagnetic toner No. 1) with a weight average particle diameter of 12.5 μm.

The present invention will be described below in greater detail by giving Examples.

EXAMPLE 1

To 100 parts of the magnetic toner No. 1, 0.8 part by weight of fine silica powder having been made hydrophobic using dimethylsilicone oil (BET surface specific area: 140 $m^2/g$; amount of silicone oil: 16% by weight) and 0.4 part by weight of the aggregate No. 1, having a BET specific surface area of 2.5 $m^2/g$ were agitated and blended by means of a Henschel mixer. Thus, a developer was prepared.

This developer was applied to a modified machine of a commercially available laser beam printer LBP-B406E, manufactured by Canon Inc., having an OPC photosensitive drum (diameter: 30 mm) with a surface layer made of polycarbonate resin, which was so modified that its transfer roller was rotatable at a peripheral speed equal to that of the OPC photosensitive drum and brought into contact with the OPC photosensitive drum at a contact pressure of 5 g/cm, and images were continuously printed on 2,000 sheets of paper.

At the initial stage printing and the 2,000th sheet printing, images were printed respectively on cardboad of 120 $g/m^2$ and on OHP film to make evaluation on blank areas caused by poor transfer.

Results obtained are shown in Table 3.

EXAMPLES 2 to 10

Developers were obtained in the same manner as in Example 1 except that aggregates as shown in Table 3 were used as the aggregate, and evaluation was made in the same manner as in Example 1.

Results obtained are shown in Table 3.

Comparative Example 1

A developer was obtained in the same manner as in Example 1 except that the aggregate No. 1 was not used, and evaluation was made in the same manner as in Example 1.

Results obtained are shown in Table 3.

EXAMPLES 11 to 13

Developers were obtained in the same manner as in Example 1 except that the aggregate No. 1 was added in the amount shown in Table 4, and evaluation was made in the same manner as in Example 1.

Results obtained are shown in Table 4.

EXAMPLE 14

To 100 parts of the magnetic toner No. 2, 0.4 part by weight of fine silica powder having been made hydrophobic using amino-modified silicone oil (BET surface specific area: 85 $m^2/g$; amount of amino-modified silicone oil: 10% by weight) and 0.5 part by weight of the aggregate No. 11 were agitated and blended by means of a Henschel mixer. Thus, a developer was prepared.

The developer obtained was applied to a modified machine of a copying machine NP-2020, manufactured by Canon Inc., having an OPC photosensitive drum (diameter: 30 mm) with a surface layer made of polycarbonate resin, which was so modified that its transfer assembly was constituted of to a transfer roller, and copies were continuously taken on 2,000 sheets of paper.

As the transfer roller, a roller of 16 mm in outer diameter having a conductive elastic layer formed of conductive carbon and EPDM resin was used, and this transfer roller was brought into contact with the surface of the OPC photosensitive drum at a contact pressure of 5 g/cm and was so set as to be rotatable at a peripheral speed equal to that of the OPC photosensitive drum. As conditions for a bias, a DC voltage of 3.8 kV was applied, and the current value was set at −50 μA.

At the initial stage and the 2,000th sheet copying, copies were taken respectively on cardboad of 120 g/m$^2$ and on OHP film to make evaluation on blank areas caused by poor transfer.

Results obtained are shown in Table 4.

EXAMPLES 15 to 19

Developers were obtained in the same manner as in Example 1 except that aggregates as shown in Table 4 were used as the aggregate, and evaluation was made in the same manner as in Example 1.

Results obtained are shown in Table 4.

Comparative Example 2

A developer was obtained in the same manner as in Example 14 except that the aggregate No. 11 was not used, and evaluation was made in the same manner as in Example 14.

Results obtained are shown in Table 4.

Comparative Example 3

A developer was obtained in the same manner as in Example 1 except that the aggregate No. 1 was replaced with 0.4 part by weight of dimethylsilicone oil (viscosity: 300 centistokes), and evaluation was made in the same manner as in Example 1.

Results obtained are shown in Table 4.

Comparative Example 4

A developer was prepared in the same manner as in Example 1 except that the aggregate No. 1 was replaced with the comparative aggregate No. 1, and evaluation was made in the same manner as in Example 1.

Results obtained are shown in Table 4.

Comparative Example 5

A developer was prepared in the same manner as in Example 1 except that the aggregate No. 1 was replaced with the comparative aggregate No. 2, and evaluation was made in the same manner as in Example 1.

Results obtained are shown in Table 4.

EXAMPLE 20

To 100 parts by weight of the non-magnetic toner No. 1, 0.8 part by weight of fine silica powder having been made hydrophobic using amino-modified silicone oil (BET surface specific area: 85 m$^2$/g; amount of silicone oil: 10% by weight), 0.4 part by weight of the aggregate No. 12 and 0.5 part by weight of fine polyvinylidene fluoride particles were agitated and blended by means of a Henschel mixer. Thus, a developer was prepared.

Next, 8 parts by weight of this developer and 100 parts by weight of a magnetic carrier (magnetic ferrite carrier resin-coated using a mixture of styrene-acrylic copolymer and vinylidene fluoride polymer; average particle diameter: 65 μm) were blended by means of a v-type mixer to obtain a two component type developer.

This developer was applied to a color developing assembly of the modified machine of a copying machine NP-2020 as used in Example 14, and copies were taken on 1,000 sheets of paper.

At the initial stage and the 1,000th sheet copying, copies were taken respectively on cardboad of 120 g/m$^2$ and on OHP film to make evaluation on blank areas caused by poor transfer.

Results obtained are shown in Table 5.

EXAMPLE 21

A developer was prepared in the same manner as in Example 20 except that the aggregate No. 12 was replaced with the aggregate No. 15, and evaluation was made in the same manner as in Example 20.

Results obtained are shown in Table 5.

EXAMPLES 22 to 25

Developers were prepared in the same manner as in Example 1 except that the aggregate No. 1 was replaced with the aggregates as shown in Table 5, and evaluation was made in the same manner as in Example 1.

Results obtained are shown in Table 5.

TABLE 3

| | | | Blank areas caused by poor transfer | | | | | | | |
|---|---|---|---|---|---|---|---|---|---|---|
| | | | Initial stage | | 2,000th sheet | | Image density | | Coarse image | |
| | Toner | Aggregate (pbw) | Card-board | OHP | Card-board | OHP | Initial stage | 2,000th sheet | Initial stage | 2,000th sheet |
| Example: | | | | | | | | | | |
| 1 | Magnetic toner No.1 | Aggregate No.1 (0.4 part) | A | A | A | A | 1.45 | 1.45 | A | A |
| 2 | Magnetic toner No.1 | Aggregate No.2 (0.4 part) | A | A | A | A | 1.45 | 1.46 | A | A |
| 3 | Magnetic toner No.1 | Aggregate No.3 (0.4 part) | A | A | A | A | 1.43 | 1.43 | A | A |
| 4 | Magnetic toner No.1 | Aggregate No.4 (0.4 part) | A | A | A | A | 1.42 | 1.43 | A | A |
| 5 | Magnetic toner | Aggregate No.5 | A | A | A | A | 1.44 | 1.44 | A | A |

TABLE 3-continued

| | | | Blank areas caused by poor transfer | | | | | | | |
|---|---|---|---|---|---|---|---|---|---|---|
| | | | Initial stage | | 2,000th sheet | | Image density | | Coarse image | |
| | Toner | Aggregate (pbw) | Card-board | OHP | Card-board | OHP | Initial stage | 2,000th sheet | Initial stage | 2,000th sheet |
| | No.1 | (0.4 part) | | | | | | | | |
| 6 | Magnetic toner No.1 | Aggregate No.6 (0.4 part) | A | A | A | A | 1.45 | 1.45 | A | A |
| 7 | Magnetic toner No.1 | Aggregate No.7 (0.4 part) | A | A | A | A | 1.44 | 1.41 | A | B |
| 8 | Magnetic toner No.1 | Aggregate No.8 (0.4 part) | A | A | A | A | 1.44 | 1.42 | A | AB |
| 9 | Magnetic toner No.1 | Aggregate No.9 (0.4 part) | A | A | A | A | 1.45 | 1.45 | A | A |
| 10 | Magnetic toner No.1 | Aggregate No.10 (0.4 part) | A | AB | A | AB | 1.45 | 1.45 | A | A |
| Comparative Example: | | | | | | | | | | |
| 1 | Magnetic toner No.1 | — | A | C | A | C | 1.45 | 1.45 | A | A |

TABLE 4

| | | | Blank areas caused by poor transfer | | | | | | | |
|---|---|---|---|---|---|---|---|---|---|---|
| | | | Initial stage | | 2,000th sheet | | Image density | | Coarse image | |
| | Toner | Aggregate (pbw) | Card-board | OHP | Card-board | OHP | Initial stage | 2,000th sheet | Initial stage | 2,000th sheet |
| Example: | | | | | | | | | | |
| 11 | Magnetic toner No.1 | Aggregate No.1 (0.04 part) | A | AB | A | AB | 1.45 | 1.46 | A | A |
| 12 | Magnetic toner No.1 | Aggregate No.1 (0.2 part) | A | A | A | A | 1.44 | 1.45 | A | A |
| 13 | Magnetic toner No.1 | Aggregate No.1 (1 part) | A | A | A | A | 1.44 | 1.44 | A | A |
| 14 | Magnetic toner No.2 | Aggregate No.11 (0.5 part) | A | AB | A | A | 1.42 | 1.42 | A | A |
| 15 | Magnetic toner No.2 | Aggregate No.12 (0.5 part) | A | A | A | A | 1.41 | 1.41 | A | A |
| 16 | Magnetic toner No.2 | Aggregate No.13 (0.5 part) | A | A | A | A | 1.41 | 1.41 | A | A |
| 17 | Magnetic toner No.2 | Aggregate No.14 (0.5 part) | A | A | A | A | 1.42 | 1.39 | A | B |
| 18 | Magnetic toner No.2 | Aggregate No.15 (0.5 part) | A | A | A | A | 1.42 | 1.42 | A | A |
| 19 | Magnetic toner No.2 | Aggregate No.16 (0.5 part) | A | A | A | A | 1.42 | 1.41 | A | A |
| Comparative Example: | | | | | | | | | | |
| 2 | Magnetic toner No.2 | — | A | C | A | C | 1.42 | 1.41 | A | A |
| 3 | Magnetic toner No.1 | — *(0.4 part) | A | A | A | A | 1.35 | 1.38 | B | C |
| 4 | Magnetic toner No.1 | Comp. Aggr. No.1 (0.4 part) | A | C | A | C | 1.45 | 1.45 | A | A |
| 5 | Magnetic toner No.1 | Comp. Aggr. No.2 (0.4 part) | A | AB | — | — | 1.35 | 1.18 | B | C |

*Dimethylsilicone oil

TABLE 5

| | | | Blank areas caused by poor transfer | | | | Image density | | Coarse image | |
|---|---|---|---|---|---|---|---|---|---|---|
| | | | Initial stage | | 1,000th or 2,000th sheet | | | 1,000th or | | 1,000th or |
| Example: | Toner | Aggregate (pbw) | Card-board | OHP | Card-board | OHP | Initial stage | 2,000th sheet | Initial stage | 2,000th sheet |
| 20 | Non-magnetic Toner No.1 | Aggregate No.12 (0.4 part) | A | A | A | A | 1.25 | 1.23 | A | A |
| 21 | Non-magnetic Toner No.1 | Aggregate No.15 (0.4 part) | A | A | A | A | 1.24 | 1.22 | A | A |
| 22 | Magnetic toner No.1 | Aggregate No.17 (0.5 part) | A | A | A | A | 1.44 | 1.43 | A | AA |
| 23 | Magnetic toner No.1 | Aggregate No.18 (0.5 part) | A | A | A | A | 1.42 | 1.42 | A | A |
| 24 | Magnetic toner No.1 | Aggregate No.19 (0.5 part) | A | A | A | AB | 1.42 | 1.39 | A | AB |
| 25 | Magnetic toner No.1 | Aggregate No.20 (0.5 part) | A | AB | A | AB | 1.38 | 1.35 | AB | AB |

Evaluation on blank areas caused by poor transfer:

A: No problem at all.

AB: Very slightly occurred or so.

B: Occurred, by practically usable.

C: Poor.

Coarse images:

AA: Very uniform and no problem at all.

A: Uniform and no problem at all.

AB: Very slightly coarse, but no problem.

B: A little coarse, but no problem.

C: Poor.

What is claimed is:

1. An image forming method comprising:

electrostatically charging a latent image bearing member;

forming an electrostatic image on the latent image bearing member thus charged;

developing the electrostatic image by the use of a developer to form a toner image on the latent image bearing member; and transferring the toner image formed on the latent image bearing member, to a transfer medium through a contact transfer means to which a bias voltage is applied;

wherein said developer comprises 100 parts by weight of a toner and 0.01 part by weight to 10 parts by weight of an aggregate of fine particles, said aggregate holds a silicone compound selected from the group consisting of a silicone oil and a silicone varnish, in an amount of from 20% by weight to 90% by weight, and has a dissolving matter in a quantity not less than 10% by weight as measured by Soxhlet extraction using chloroform.

2. The method according to claim 1, wherein said contact transfer means has a transfer roller.

3. The method according to claim 2, wherein said transfer roller is brought into pressure contact with the latent image bearing member at a contact pressure of from 1 g/cm to 300 g/cm.

4. The method according to claim 3, wherein said transfer roller is brought into pressure contact with the latent image bearing member at a contact pressure of from 3 g/cm to 100 g/cm.

5. The method according to claim 1, wherein said contact transfer means has a transfer belt.

6. The method according to claim 1, wherein a DC voltage of from +0.2 kV to +10 kV is applied to said contact transfer means.

7. The method according to claim 1, wherein a DC voltage of from −0.2 kV to −10 kV is applied to said contact transfer means.

8. The method according to claim 1, wherein said aggregate has a BET specific surface area of from 0.01 $m^2/g$ to 50 $m^2/g$.

9. The method according to claim 8, wherein said aggregate holds the silicone compound in an amount of from 27% by weight to 85% by weight.

10. The method according to claim 1, wherein said aggregate has a BET specific surface area of from 0.05 $m^2/g$ to 30 $m^2/g$.

11. The method according to claim 1, wherein said aggregate has a BET specific surface area of from 0.05 $m^2/g$ to 30 $m^2/g$ and is contained in an amount of from 0.01 part by weight to 10 parts by weight based on 100 parts by weight of the toner, and a fine silica powder having a BET specific surface area of from 50 $m^2/g$ to 400 $m^2/g$ is further contained in an amount of from 0.01 part by weight to 8 parts by weight based on 100 parts by weight of the toner.

12. The method according to claim 1, wherein said aggregate has a BET specific surface area of from 0.05 $m^2/g$ to 30 $m^2/g$ and is contained in an amount of from 0.01 part by weight to 10 parts by weight based on 100 parts by weight of the toner, and a fine titanium oxide powder is further contained in an amount of from 0.01 part by weight to 8 parts by weight based on 100 parts by weight of the toner.

13. The method according to claim 1, wherein said fine particles are formed of an inorganic compound.

14. The method according to claim 13, wherein said inorganic compound is a metal oxide.

15. The method according to claim 14, wherein said metal oxide is silicon oxide.

16. The method according to claim 14, wherein said metal oxide is aluminum oxide.

17. The method according to claim 14, wherein said metal oxide is titanium oxide.

18. The method according to claim 14, wherein said metal oxide is a double oxide formed of silicon and aluminum.

19. The method according to claim 14, wherein said metal oxide is a double oxide formed of silicon and titanium.

20. The method according to claim 14, wherein said metal oxide is a double oxide formed of aluminum and titanium.

21. The method according to claim 1, wherein said fine particles are formed of a resin.

22. The method according to claim 1, wherein said silicone oil has a viscosity at 25° C. of from 50 centistokes to 200,000 centistokes.

23. The method according to claim 22, wherein said silicone oil has a viscosity at 25° C. of from 500 centistokes to 150,000 centistokes.

24. The method according to claim 23, wherein said silicone oil has a viscosity at 25° C. of from 3,000 centistokes to 80,000 centistokes.

25. The method according to claim 20, wherein said silicone varnish has a viscosity at 25° C. of from 50 centistokes to 200,000 centistokes.

26. The method according to claim 1, wherein said silicone varnish has a viscosity at 25° C. of from 3,000 centistokes to 80,000 centistokes.

27. The method according to claim 1, wherein said toner has a weight average particle diameter of from 3 μm to 15 μm.

28. The method according to claim 27, wherein said toner has a weight average particle diameter of from 4 μm to 9 μm.

29. The method according to claim 1, wherein said aggregate is contained in an amount of from 0.03 part by weight to 5 parts by weight based on 100 parts by weight of the toner.

30. The method according to claim 1, wherein said aggregate is contained in an amount of from 0.05 part by weight to 2 parts by weight based on 100 parts by weight of the toner.

31. The method according to claim 1, wherein said silicone oil has a viscosity at 25° C. of from 3500 to 12000 centistokes.

32. The method according to claim 1, wherein said aggregate has a dissolving matter in a quantity of 27% by weight to 76% by weight as measured by Soxhlet extraction using chloroform.

33. The method according to claim 1, wherein said aggregate holds the silicone oil in an amount of from 30% by weight to 80% by weight.

34. The method according to claim 1, wherein said aggregate is contained in an amount of from 0.05 part by weight to 2 parts by weight based on 100 parts by weight of the toner, holds the silicone oil in an amount of from 30% by weight to 80% by weight, and has a dissolving matter in a quantity of 27% by weight to 76% by weight as measured by Soxhlet extraction using chloroform.

35. The method according to claim 34, wherein said aggregate has a BET specific surface area of from 0.05 $m^2/g$ to 30 $m^2/g$ and said silicone oil has a viscosity at 25° C. of from 3000 to 80000 centistokes.

36. A developer for developing electrostatic images, comprising 100 parts by weight of a toner and 0.01 part by weight to 10 parts by weight of an aggregate of fine particles, said aggregate holds a silicone compound selected from the group consisting of a silicone oil and a silicone varnish, in an amount of from 20% by weight to 90% by weight, and has a dissolving matter in a quantity not less than 10% by weight as measured by Soxhlet extraction using chloroform.

37. The developer according to claim 36, wherein said aggregate has a BET specific surface area of from 0.01 $m^2/g$ to 50 $m^2/g$.

38. The developer according to claim 37, wherein said aggregate holds the silicone compound in an amount of from 27% by weight to 85% by weight.

39. The developer according to claim 36, wherein said aggregate has a BET specific surface area of from 0.05 $m^2/g$ to 30 $m^2/g$.

40. The developer according to claim 36, wherein said aggregate has a BET specific surface area of from 0.05 $m^2/g$ to 30 $m^2/g$ and is contained in an amount of from 0.01 part by weight to 10 parts by weight based on 100 parts by weight of the toner, and a fine silica powder having a BET specific surface area of from 50 $m^2/g$ to 400 $m^2/g$ is further contained in an amount of from 0.01 part by weight to 8 parts by weight based on 100 parts by weight of the toner.

41. The developer according to claim 36, wherein said aggregate has a BET specific surface area of from 0.05 $m^2/g$ to 30 $m^2/g$ and is contained in an amount of from 0.01 part by weight to 10 parts by weight based on 100 parts by weight of the toner, and a fine titanium oxide powder is further contained in an amount of from 0.01 part by weight to 8 parts by weight based on 100 parts by weight of the toner.

42. The developer according to claim 36, wherein said fine particles are formed of an inorganic compound.

43. The developer according to claim 42, wherein said inorganic compound is a metal oxide.

44. The developer according to claim 43, wherein said metal oxide is silicon oxide.

45. The developer according to claim 43, wherein said metal oxide is aluminum oxide.

46. The developer according to claim 43, wherein said metal oxide is titanium oxide.

47. The developer according to claim 43, wherein said metal oxide is a composite oxide formed of silicon and aluminum.

48. The developer according to claim 43, wherein said metal oxide is a double oxide formed of silicon and titanium.

49. The developer according to claim 43, wherein said metal oxide is a double oxide formed of aluminum and titanium.

50. The developer according to claim 36, wherein said fine particles are formed of a resin.

51. The developer according to claim 36, wherein said silicone oil has a viscosity at 25° C. of from 50 centistokes to 200,000 centistokes.

52. The developer according to claim 51, wherein said silicone oil has a viscosity at 25° C. of from 500 centistokes to 150,000 centistokes.

53. The developer according to claim 52, wherein said silicone oil has a viscosity at 25° C. of from 3,000 centistokes to 80,000 centistokes.

54. The developer according to claim 36, wherein said silicone varnish has a viscosity at 25° C. of from 50 centistokes to 200,000 centistokes.

55. The developer according to claim 36, wherein said silicone varnish has a viscosity at 25° C. of from 3,000 centistokes to 80,000 centistokes.

56. The developer according to claim 36, wherein said toner has a weight average particle diameter of from 3 μm to 15 μm.

57. The developer according to claim 56, wherein said toner has a weight average particle diameter of from 4 μm to 9 μm.

58. The developer according to claim 36, wherein said aggregate is contained in an amount of from 0.03 part by weight to 5 parts by weight based on 100 parts by weight of the toner.

59. The developer according to claim 36, wherein said aggregate is contained in an amount of from 0.05 part by weight to 2 parts by weight based on 100 parts by weight of the toner.

60. The developer according to claim 36, wherein said silicone oil has a viscosity at 25° C. of from 3500 to 12000 centistokes.

61. The developer according to claim 36, wherein said aggregate has a dissolving matter in a quantity of 27% by weight to 76% by weight as measured by Soxhlet extraction using chloroform.

62. The developer according to claim 36, wherein said aggregate holds the silicone oil in an amount of from 30% by weight to 80% by weight.

63. The developer according to claim 36, wherein said aggregate is contained in an amount of from 0.05 part by weight to 2 parts by weight based on 100 parts by weight of the toner, holds the silicone oil in an amount of from 30% by weight to 80% by weight, and has a dissolving matter in a quantity of 27% by weight to 76% by weight as measured by Soxhlet extraction using chloroform.

64. The developer according to claim 63, wherein said aggregate has a BET specific surface area of from 0.05 $m^2/g$ to 30 $m^2/g$ and said silicone oil has a viscosity at 25° C. of from 3000 to 80000 centistokes.

* * * * *

UNITED STATES PATENT AND TRADEMARK OFFICE

CERTIFICATE OF CORRECTION

PATENT NO. : 5,710,965
DATED : January 20, 1998
INVENTOR(S) : NOZAWA et al.

It is certified that error appears in the above-identified patent and that said Letters Patent is hereby corrected as shown below:

Column 5

Line 60, "compunds" should read --compounds--.

Column 12

Line 53, "may" should read --may be--.

Column 14

Line 19, "describe" should read --described--.

Column 16

Line 27, "to tends" should read --tending--.

Column 22

Line 1, "the the" should read --that the--.

UNITED STATES PATENT AND TRADEMARK OFFICE

CERTIFICATE OF CORRECTION

PATENT NO. : 5,710,965

DATED : January 20, 1998

INVENTOR(S) : NOZAWA et al.

It is certified that error appears in the above-indentified patent and that said Letters Patent is hereby corrected as shown below:

Column 31

Line 15, "claim 20" should read --claim 1--.

Signed and Sealed this

Seventh Day of July, 1998

Bruce Lehman

*Attest:*

BRUCE LEHMAN

*Attesting Officer*

*Commissioner of Patents and Trademarks*